US005533533A

United States Patent [19]

Shing

[11] Patent Number: 5,533,533

[45] Date of Patent: Jul. 9, 1996

[54] FOLDABLE HAIR CLIP WITH A COMB

[76] Inventor: Yeh. S. Shing, No. 119-3, Sec. 3, Pa-Te Rd., Taipei, Taiwan

[21] Appl. No.: 375,401

[22] Filed: Jan. 18, 1995

[51] Int. Cl.[6] ..... A45D 8/28

[52] U.S. Cl. ..... 132/279; 132/276; 132/277

[58] Field of Search ..... 132/148, 173, 132/276, 277, 279, 282; 16/357, 360, 361

[56] References Cited

U.S. PATENT DOCUMENTS

| | | | |
|---|---|---|---|
| 694,934 | 3/1902 | Machado | 132/279 |
| 849,766 | 4/1907 | Baker | 132/279 |
| 1,595,595 | 8/1926 | Bonat et al. | 132/273 |
| 3,344,462 | 10/1967 | Webster | 16/357 |
| 4,796,331 | 1/1989 | White et al. | 16/360 |
| 5,284,167 | 2/1994 | Gill | 132/279 |

*Primary Examiner*—Cary E. O'Connor
*Assistant Examiner*—Pedro Philogene
*Attorney, Agent, or Firm*—W. Wayne Liauh

[57] ABSTRACT

A foldable hair clip with a comb is disclosed which comprises: (a) a clip plate, which has an inner surface provided with a pair of comb pivot seats, a pair of clip strip seats near one end thereof, and a stud button near another end; (b) a clip strip, which has a pivot on one end thereof pivotally affixed to the clip strip seats, a notch on the other end mating the stud button provided on the clip plate so as to be clamped thereto, and an inner surface which is provided with a plurality of teeth; (c) a comb, which has two symmetrical short pins on two ends, respectively, thereof, the symmetrical short pins are pivotably fit into the comb pivot seats, respectively. The comb is initially folded against the clip plate via a cooperated action between the symmetrical short pins and the comb pivot seats so as to allow the combined foldable hair clip and comb to be used as a hair clip. On the other hand, when the foldable hair clip with a comb is to be used as a comb, the user can unclamp the notch from the stud button and unfold the comb. In a preferred embodiment, the clip strip seats are provided with two pairs of positioning holes, each pair of the positioning holes being dimensioned to receive the pivot of the clip strip and a sliding groove which is provided between the pair of positioning holes to allow the pivot to move therealong. The pairs of positioning holes are formed at different distances from the clip strip such that when the pivot is received by one pair of the positioning holes, the clip strip will be firmly clamped by the stud button. On the other hand, the clip strip will be released from the stud button and is free to pivot when the pivot is received by another pair of the positioning holes.

3 Claims, 6 Drawing Sheets

FOLDABLE HAIR CLIP WITH A COMB

BACKGROUND OF THE INVENTION

A conventional hair clip is used only to clip hair combed; it is necessary portable tool for a female; however, the conventional hair clip can only be used as a hair clip, and the hairs can not only be clipped; the hairs not only have to be fixed in shape, but also have to be forked in place. A female has to carry with a hair clip, a comb and a hair fork, which take a lot of space.

SUMMARY OF THE INVENTION

This invention relates to a foldable hair clip with a comb, and it comprises a clip plate, a clip strip and a comb. The comb is mounted in the inner surface of the clip plate by means of two short pins. One end of the clip strip is mounted in the clip plate by means of a pivot. The inner surface of the clip strip is furnished with a clip strip seat, which has two functions on an optional basis; the clip strip seat has two sets of positioning holes. The clip strip can be pushed to fit one set of the positioning holes for being used as a clip or turn function. When the clip strip is positioned at clip position, it is a hair clip. When the clip strip is turned, the comb can be released as a comb or a hair fork. The prime object of the present invention is to provide a foldable hair clip to be used as comb, a hair fork and a hair clip.

DETAILED DESCRIPTION

Figure 1:
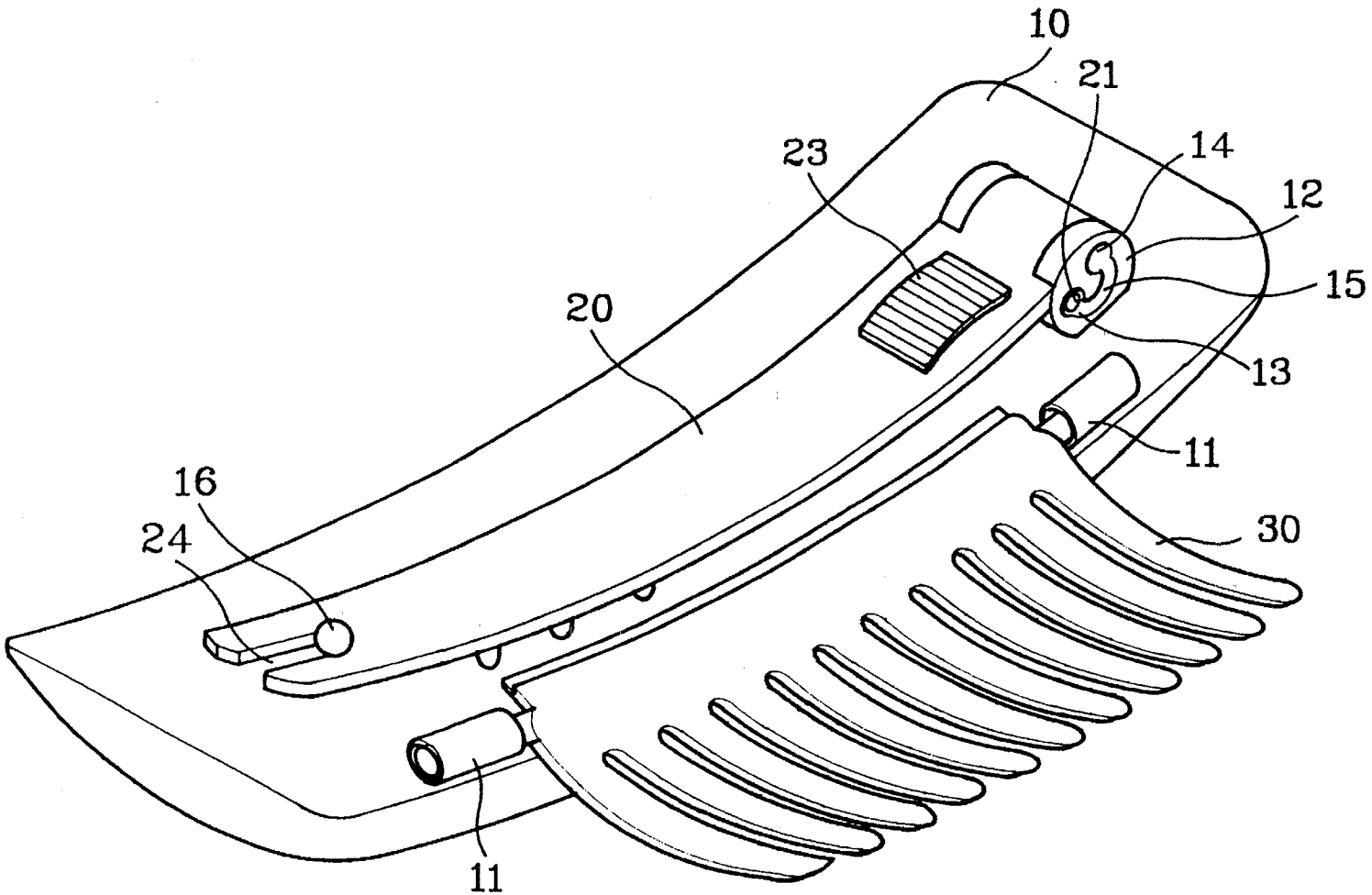
FIG. 1 is a perspective view of an embodiment according to the present invention.
Figure 2:
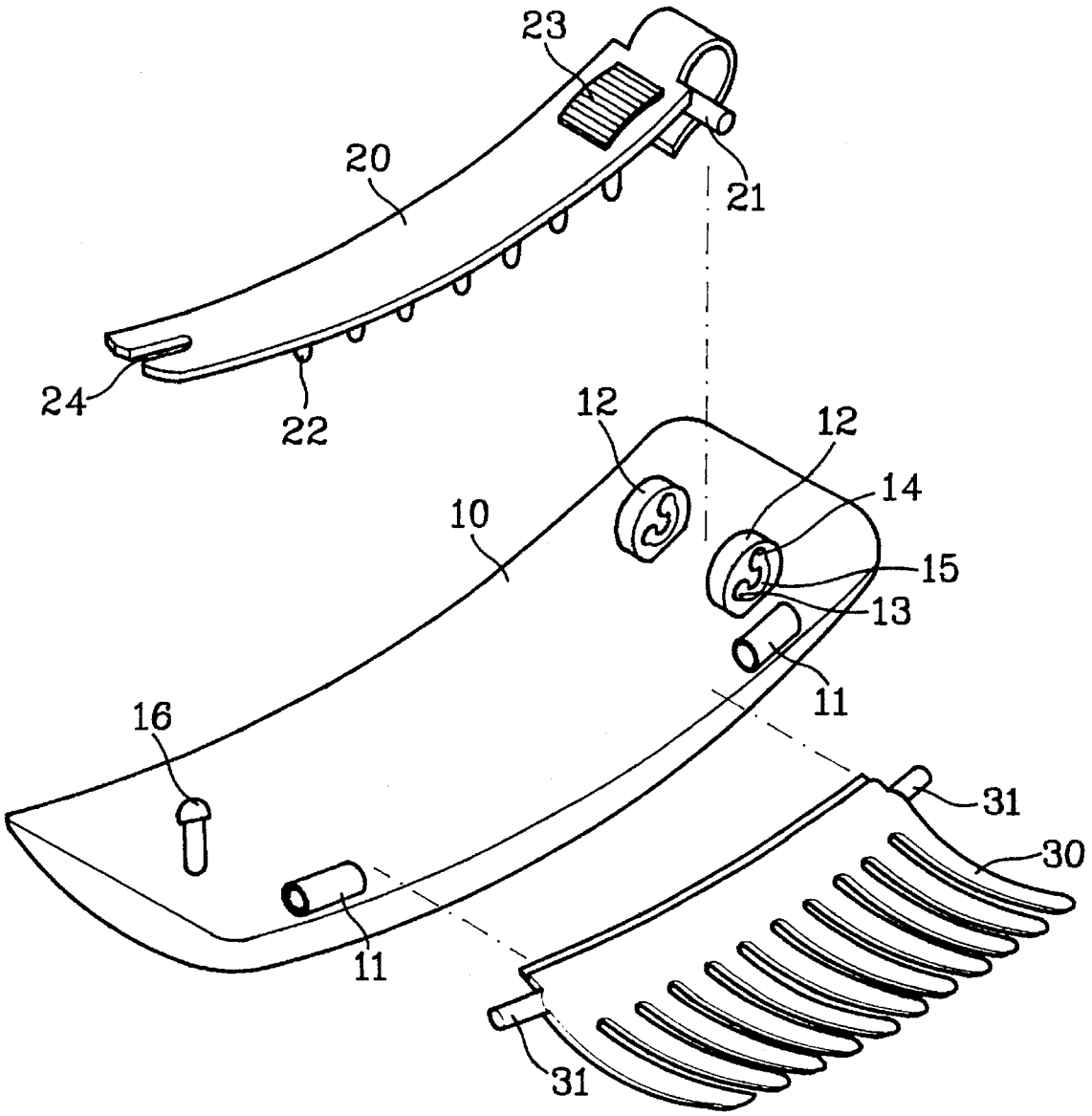
FIG. 2 is a disassembled view of the present invention.
Figure 4:
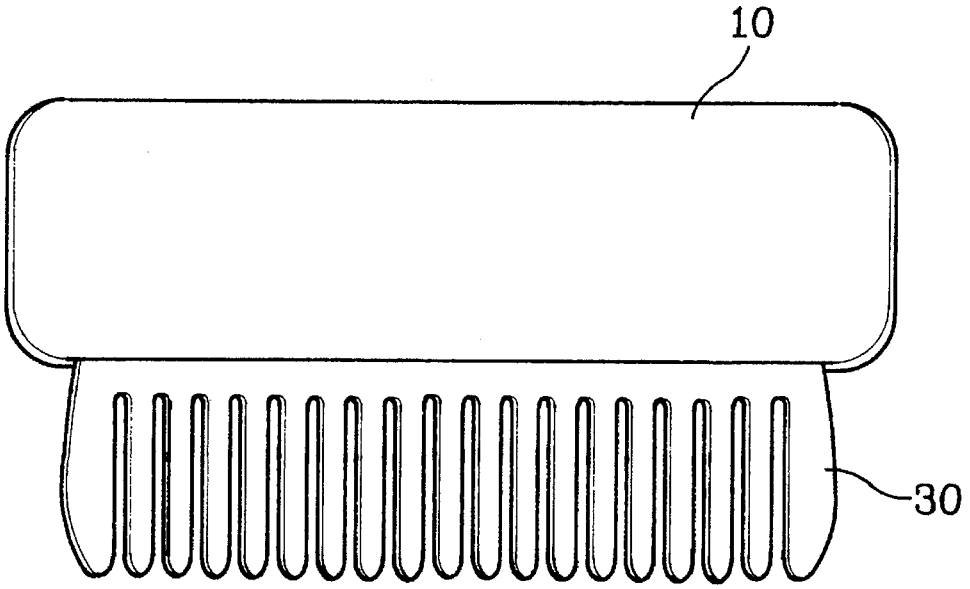
FIG. 4 is a from view of the present invention.
Figure 5:
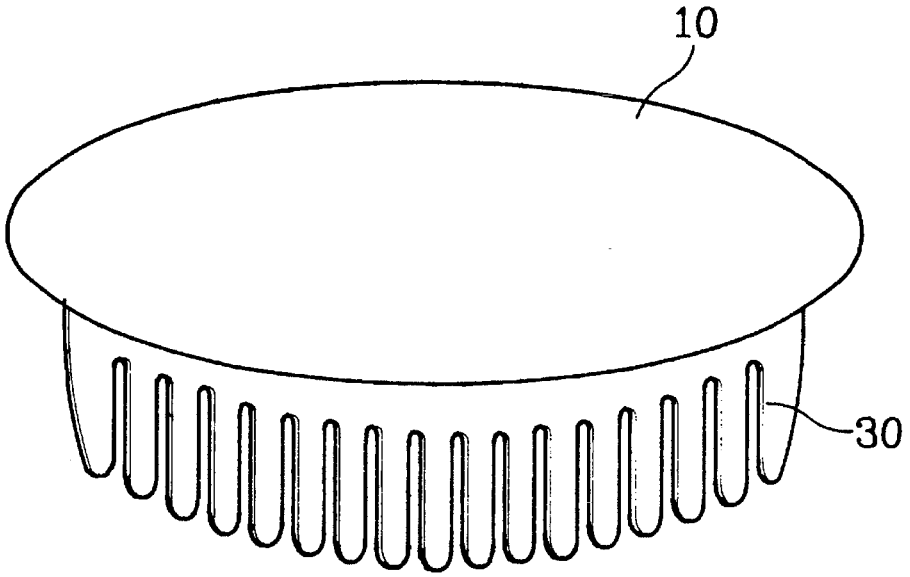
FIG. 5 is a another embodiment according to the present invention, in which the clip plate is an oval shaped one.
Figure 6:
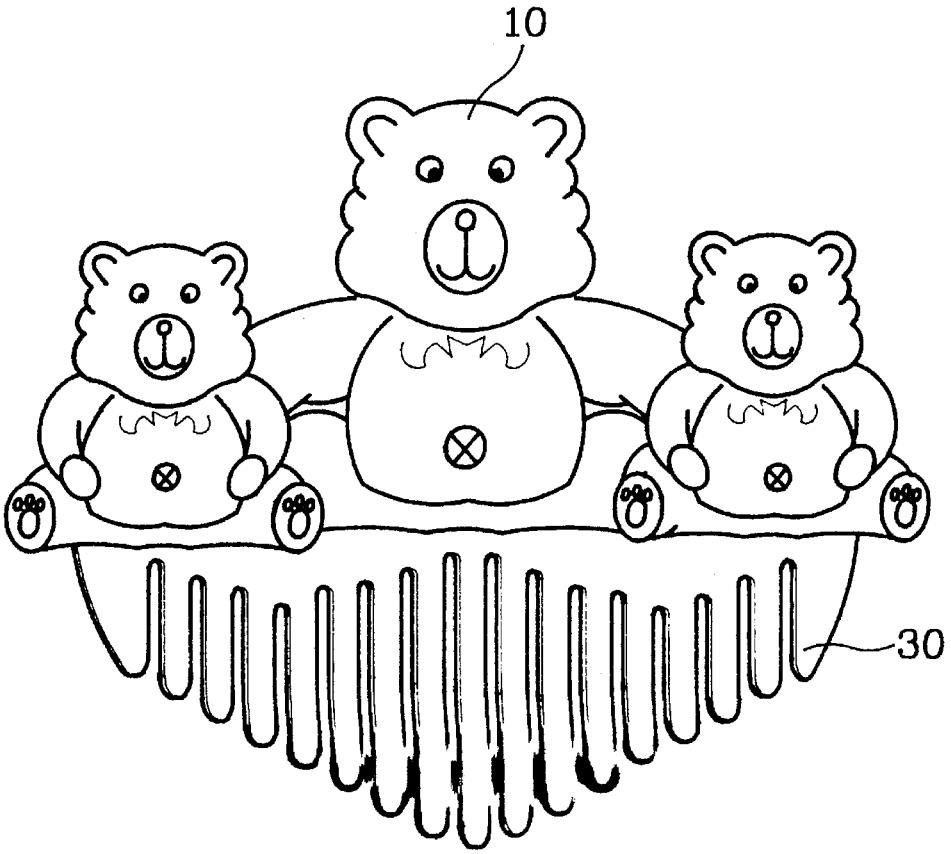
FIG. 6 is still another embodiment according to the present invention, in which the clip plate is an animal pattern.

Referring to FIGS. 1 and 2, the present invention comprises a clip plate 10, a clip strip 20, and a comb 30; the clip plate 10 is a slightly curved rectangular plate (as shown in FIGS. 1 to 4). The shape of the clip plate 10 may be varied, if necessary; for instance, the clip plate 10 can be an oval shaped one as shown in FIG. 5, or can be an animal pattern one as shown in FIG. 6. In other words, the shape of the clip plate 10 is not limited, i.e., it can be in any suitable shape, such as an oval, rectangular, any geometrical shape, an animal pattern or plant pattern, etc. On both ends of one side of the clip plate 10, there are, respectively, two symmetrical comb pivot seats 11. On one end of the clip plate 10, there are two symmetrical clip strip seats 12, which are used for mounting the clip strip 20, and for providing two function to clip or to turn for the clip strip 20. Each of the clip strip seat 12 has two pivotal positioning holes 13 and 14, which are in communication with a sliding groove 15. The pivotal positioning hole 13 is lower than the pivotal positioning hole 14 in terms of the top surface of the clip plate 10; the diameter of the pivotal positioning hole 14 is slightly larger than that of pivotal positioning hole 13. Between the inner side of the clip plate 10 and one end of the clip strip 20, there is a stud button 16 to be mated with a notch 24.

The clip strip 20 is a curved piece, and slightly narrower than the clip plate 10; one end of the clip strip 20 has a downward curved hook attached with a pivot 21, which is perpendicular to the clip strip 20, and is to be fitted into the pivotal positioning hole 13; the pivot 21 can be pushed to slide in the sliding groove 15. The inner side of the clip strip 20 is provided with a plurality of teeth 22 to provide a gripping force. A granular push button 23 is furnished on one end of the clip strip 20 nearing the pivot 21; the push button is furnished with a granular surface. The push button 23 can be furnished by 9 molding method with the clip strip 20, or by gluing to the clip strip 20. The opposite end of the clip strip 20 to one end of the pivot 21 is furnished with a notch 24 to be mated with the stud button 16 located on the inner surface of the clip plate 10.

The comb 30 is a piece, having a width almost equal to or less than that of the clip plate 10, and is slightly flexible and curved. The length of the comb 30 is just to be mounted between the two comb pivot seat 11. Both ends of the comb 30 are provided with two short pins 31 respectively. The teeth of the comb 30 can be arranged in straight (as shown in FIGS. 1 to 4), or arranged in a slightly curved shape (as shown in FIG. 5), or can be made as a taper shape (as shown in FIG. 6) or other shapes so as to fit the shape of the clip plate 10.

Figure 3:
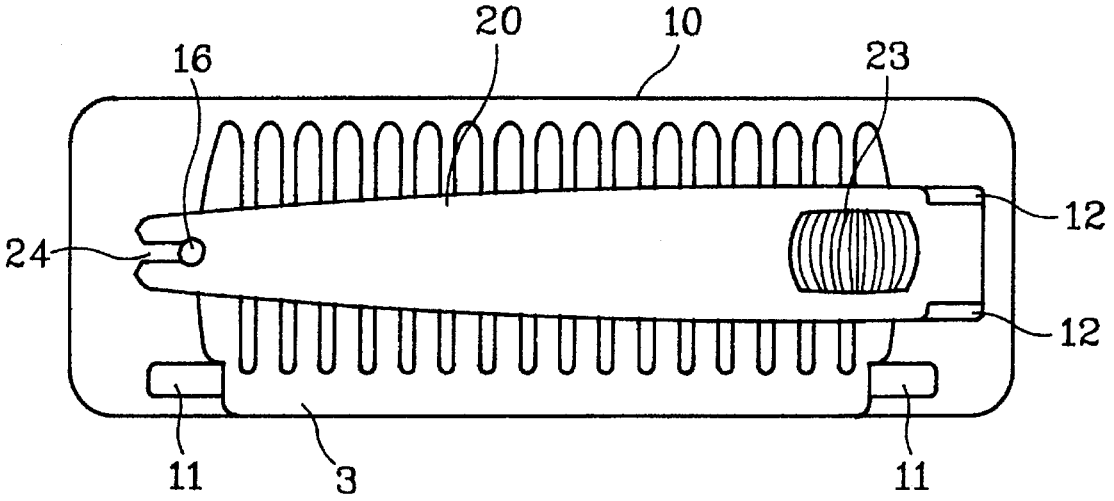
FIG. 3 is a rear view of the present invention.
Figure 8:
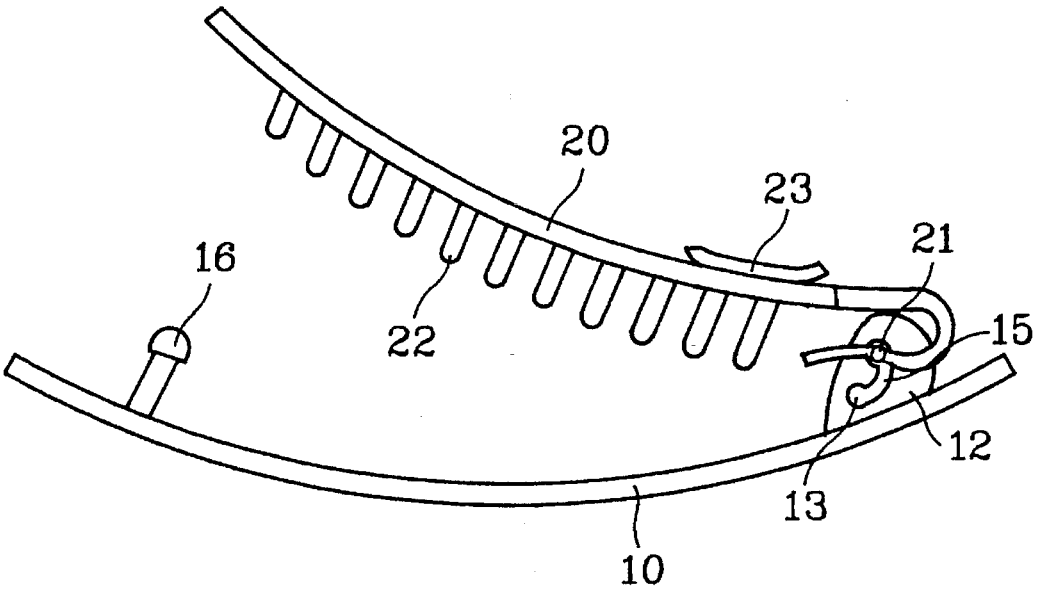
FIGS. 7 to 9 illustrate the operation steps of the present invention.
Figure 7:
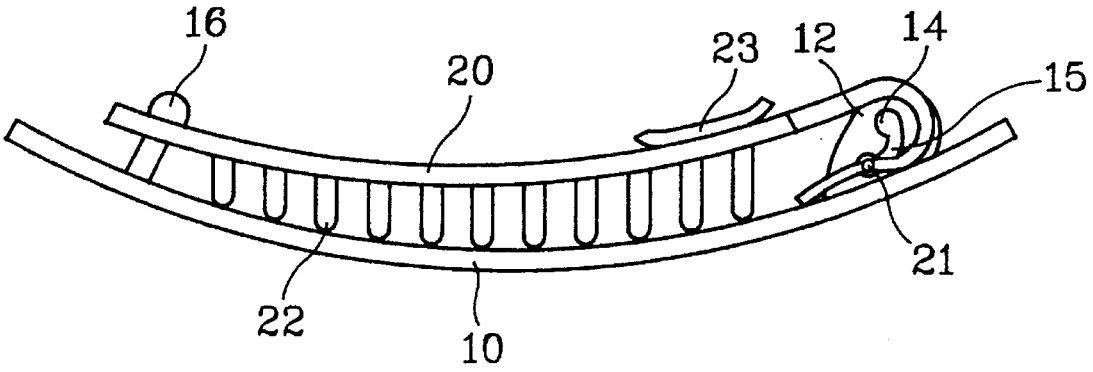
Figure 9:
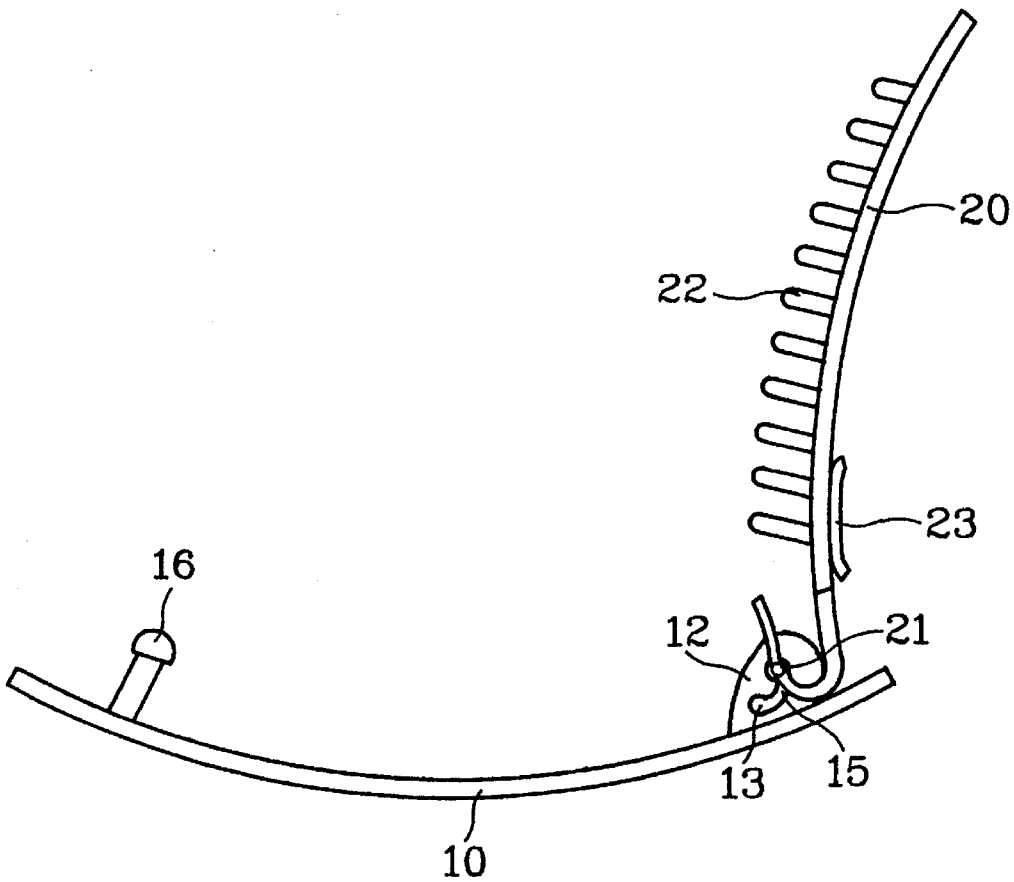

To assembly the present invention, the comb 30 can be bent slightly to the extent of having the two short pins 31 able to fit into the two short pins 31 able to fit into the two comb pivot seats 11 (as shown in FIGS. 1 and 3) on the clip plate 10 respectively, and then the comb 30 can be folded to the inner surface of the clip plate 10 in a curved manner. The comb 30 can be tamed freely at a given angle; then, the clip strip 20 is mounted in place by fitting the pivot 21 into the positioning holes 13. As soon as the pivot 21 is fitted into the positioning holes 13, the clip strip 20 can be folded on the inner surface of the clip plate 10 but over the comb 30 (as shown in FIGS. 3 and 7). One end of the clip strip 20 nearing the pivot 21 will press against the inner surface of the clip plate 10, while the other end thereof will also press against the clip plate 10 to provide a clip function for clipping hairs. The clip strip 20 can be opened with a little force before clipping hairs. When the clip strip 20 is tamed to the clip plate 10, the stud button 16 will be mated with the notch 24 so as to have the clip strip 20 surely clamped on hairs. To use the comb 30, the user has to open the clip strip 20 first before unfolding the comb 30 out of the clip plate 10, i.e., to push the pushing button 23 to have the pivot 21 of the clip strip 20 slid into a positioning hole 14 via a sliding groove 15; since the positioning hole 14 is farther from the inner surface of the clip plate 10, the pivot 21 can rotate freely in the positioning hole 14, and one end of the clip strip 20 will not be pushed against the clip plate 10 (as shown in FIG. 8); as a result, the clip strip 20 can easily be tamed and opened along the pivot 21 (as shown in FIG. 9). Of course, to separate the stud button 16 from the notch 24, a suitable force has to be applied. After the clip strip 20 is opened, the comb 30 can be opened completely. Since the comb 30 has a given flexibility, it can be pressed along the curvature of the clip plate 10 for combing hairs, or being used as a hair fork (as shown in FIGS. 1, 4, 5 and 6). After the comb is opened, the clip strip 20 can be pushed with the pushing button 23 to have the pivot 21 slid back into the positioning hole 13, and then the clip strip 20 will be in close contact with the clip plate 10 without hindering the normal functions of the comb 30. Further, the present invention can be used as a hair clip and a hair fork simultaneously.

Since the present invention has put a comb, a hair fork and a hair clip into a single unit, it can easily be carried by a user with a small space, and it is deemed practical in terms of use.

I claim:

1. A foldable hair clip with a comb comprising:

a clip plate, being a curved piece, said clip plate having an inner surface which is provided with a pair of comb pivot seats, a pair of clip strip seats near one end thereof and a stud button near another end, said pair of clip strip seats being provided to allow a clip strip to be pivotally affixed thereto;

said clip strip, being a curved piece, having a pivot on one end thereof pivotally affixed to said clip strip seats, a notch on the other end mating said stud button provided on said clip plate so as allow said clip strip to be clamped to said stud button, and an inner surface which is provided with a plurality of teeth;

a comb, being thin comb piece, said comb having two symmetrical short pins on two ends, respectively, thereof, said symmetrical short pins being pivotably fit into said comb pivot seats, respectively;

whereby said comb is initially folded against said clip plate via a cooperative action between said symmetrical short pins and said comb pivot seats so as to allow said foldable hair clip with a comb to be used as a hair clip, and when said foldable hair clip with a comb is to be used as a comb, a user will unclamp said notch from stud button and unfold said comb;

further wherein said clip strip seats are provided with two pairs of positioning holes, each pair of said positioning holes being dimensioned to receive said pivot of said clip strip, and a sliding groove which is provided between said pair of positioning holes to allow said pivot to move therealong; said pairs of positioning holes being formed at different distances from said clip strip such that when said pivot is received by one pair of said positioning holes, said clip strip will be firmly clamped by said stud button, and said clip strip will be released from said stud button and is free to pivot when said pivot is received by another pair of said positioning holes.

2. A foldable hair clip with a comb as claimed in claim 1 wherein said clip plate is of a shape selected from the group consisting of an oval, a rectangle, an animal or a plant.

3. A foldable hair clip with a comb as claimed in claim 1 wherein said comb is of a shape selected from the group consisting of a straight shade, a curved shape or a tapered shape.

* * * * *